US005829643A

United States Patent [19]

Isabella

[11] Patent Number: 5,829,643

[45] Date of Patent: Nov. 3, 1998

[54] SELF-DEFENSE DEVICE

[76] Inventor: Rosemary Isabella, 349 Argo St., Youngstown, Ohio 44509

[21] Appl. No.: 873,906

[22] Filed: Jun. 12, 1997

[51] Int. Cl.[6] ..... B65D 83/88

[52] U.S. Cl. ..... 222/175; 222/192; 222/402.11; 463/47.4; D22/117

[58] Field of Search ..... 222/79, 175, 78, 222/192, 402.1, 402.11; 463/47.2, 47.4; D22/117

[56] References Cited

U.S. PATENT DOCUMENTS

| | | | |
|---|---|---|---|
| D. 205,456 | 8/1966 | Combs | D22/117 |
| D. 352,339 | 11/1994 | McGowan et al. | D22/117 |
| D. 365,622 | 12/1995 | Edwards | D22/117 |
| D. 375,994 | 11/1996 | Collins et al. | 22/117 |
| 2,099,447 | 11/1937 | Matsuyama | 463/47.4 |
| 3,385,601 | 5/1968 | Black | 463/47.4 |
| 3,413,666 | 12/1968 | Johnson, Jr. | 222/79 X |
| 3,756,467 | 9/1973 | Anketell | 222/192 X |
| 4,044,922 | 8/1977 | Bordelon | 222/402.11 X |
| 4,096,629 | 6/1978 | Levine | 463/47.4 |
| 5,242,349 | 9/1993 | Reiff et al. | 222/192 X |
| 5,318,492 | 6/1994 | Quinn | 222/175 X |
| 5,392,961 | 2/1995 | Starrett | 222/402.11 X |
| 5,556,003 | 9/1996 | Johnson et al. | 222/175 X |

*Primary Examiner*—Kenneth Bomberg

[57] ABSTRACT

A new Self-Defense Device for thwarting off a would-be attacker and allowing a potential victim to flee to safety. The inventive device includes a grasping member adapted for grasping thereof in a user's hand, a plurality of spaced spikes protruding downward from the grasping member, and an end spike protruding from a second end of the grasping member. A self-defense chemical irritant is disposed within a hollow interior chamber of the grasping member and an actuator mechanism is provided at a first end of the grasping member for effectuating release thereof. The grasping member alternatively functions as key-chain wherein a key-ring is provided at the second end thereof.

10 Claims, 4 Drawing Sheets

SELF-DEFENSE DEVICE

BACKGROUND OF THE INVENTION

1. Field of the Invention

The present invention relates to defense apparatus and more particularly pertains to a new Self-Defense Device for thwarting off a would-be attacker and allowing a potential victim to flee to safety.

2. Description of the Prior Art

The use of defense apparatus is known in the prior art. More specifically, defense apparatus heretofore devised and utilized are known to consist basically of familiar, expected and obvious structural configurations, notwithstanding the myriad of designs encompassed by the crowded prior art which have been developed for the fulfillment of countless objectives and requirements.

Known prior art defense apparatus include U.S. Pat. No. 4,044,922; U.S. Pat. No. 5,332,119; U.S. Pat. No. 4,434,914; U.S. Pat. No. 5,305,874; U.S. Pat. No. D288,468; and U.S. Pat. No. 5,287,995.

While these devices fulfill their respective, particular objectives and requirements, the aforementioned patents do not disclose a new Self-Defense Device. The inventive device includes a grasping member adapted for grasping thereof in a user's hand, a plurality of spaced spikes protruding downward from the grasping member, and an end spike protruding from a second end of the grasping member. A self-defense chemical irritant is disposed within a hollow interior chamber of the grasping member and an actuator mechanism is provided at a first end of the grasping member for effectuating release thereof. The grasping member alternatively functions as key-chain wherein a key-ring is provided at the second end thereof.

In these respects, the Self-Defense Device according to the present invention substantially departs from the conventional concepts and designs of the prior art, and in so doing provides an apparatus primarily developed for the purpose of thwarting off a would-be attacker and allowing a potential victim to flee to safety.

SUMMARY OF THE INVENTION

In view of the foregoing disadvantages inherent in the known types of defense apparatus now present in the prior art, the present invention provides a new Self-Defense Device construction wherein the same can be utilized for thwarting off a would-be attacker and allowing a potential victim to flee to safety.

The general purpose of the present invention, which will be described subsequently in greater detail, is to provide a new Self-Defense Device apparatus and method which has many of the advantages of the defense apparatus mentioned heretofore and many novel features that result in a new Self-Defense Device which is not anticipated, rendered obvious, suggested, or even implied by any of the prior art defense apparatus, either alone or in any combination thereof.

To attain this, the present invention generally comprises a grasping member adapted for grasping thereof in a user's hand, a plurality of spaced spikes protruding downward from the grasping member, and an end spike protruding from a second end of the grasping member. A self-defense chemical irritant is disposed within a hollow interior chamber of the grasping member and an actuator mechanism is provided at a first end of the grasping member for effectuating release thereof. The grasping member alternatively functions as key-chain wherein a key-ring is provided at the second end thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Self-Defense Device apparatus and method which has many of the advantages of the defense apparatus mentioned heretofore and many novel features that result in a new Self-Defense Device which is not anticipated, rendered obvious, suggested, or even implied by any of the prior art defense apparatus, either alone or in any combination thereof.

It is another object of the present invention to provide a new Self-Defense Device which may be easily and efficiently manufactured and marketed.

It is a further object of the present invention to provide a new Self-Defense Device which is of a durable and reliable construction.

An even further object of the present invention is to provide a new Self-Defense Device which is susceptible of a low cost of manufacture with regard to both materials and labor, and which accordingly is then susceptible of low prices of sale to the consuming public, thereby making such Self-Defense Device economically available to the buying public.

Still yet another object of the present invention is to provide a new Self-Defense Device which provides in the apparatuses and methods of the prior art some of the advantages thereof, while simultaneously overcoming some of the disadvantages normally associated therewith.

Still another object of the present invention is to provide a new Self-Defense Device for thwarting off a would-be attacker and allowing a potential victim to flee to safety.

Yet another object of the present invention is to provide a new Self-Defense Device which includes a grasping member adapted for grasping thereof in a user's hand, a plurality of spaced spikes protruding downward from the grasping member, and an end spike protruding from a second end of the grasping member. A self-defense chemical irritant is disposed within a hollow interior chamber of the grasping member and an actuator mechanism is provided at a first end of the grasping member for effectuating release thereof. The grasping member alternatively functions as key-chain wherein a key-ring is provided at the second end thereof.

Still yet another object of the present invention is to provide a new Self-Defense Device that can be easily and firmly grasped in a person's hand, and more specifically, can be easily and firmly grasped by individuals with smaller hands such as women.

Even still another object of the present invention is to provide a new Self-Defense Device that alternatively functions as a key chain and, as such, can be easily and conveniently carried.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
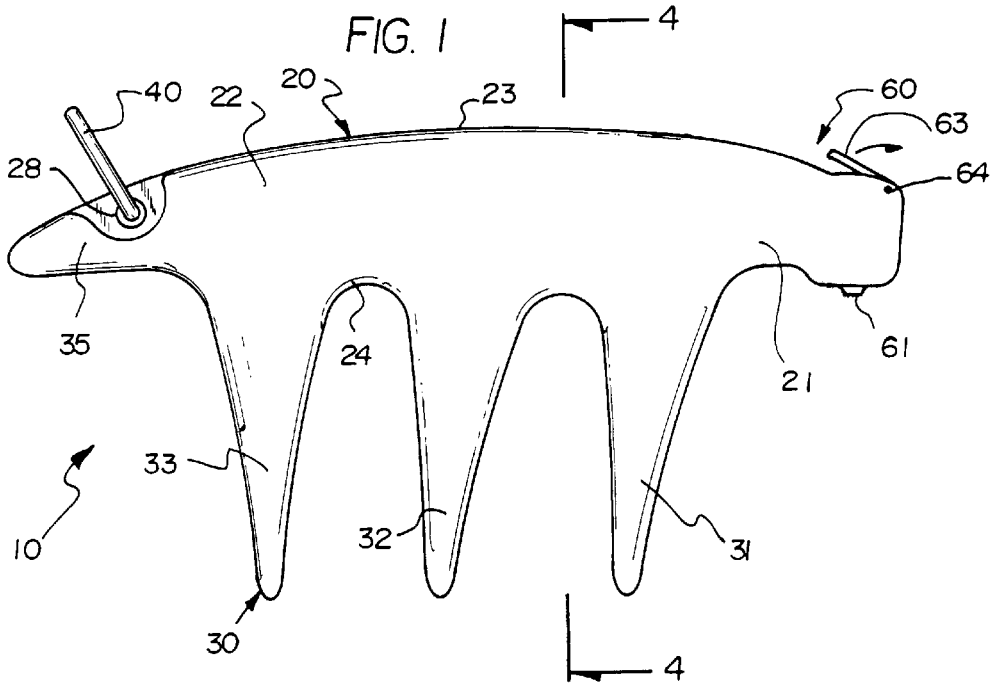
FIG. 1 is a side view of a new Self-Defense Device according to the present invention.

With reference now to the drawings, and in particular to FIGS. 1 through 7 thereof, a new Self-Defense Device embodying the principles and concepts of the present invention and generally designated by the reference numeral 10 will be described.

More specifically, it will be noted that the Self-Defense Device 10 comprises a grasping member 20 adapted for grasping thereof in a user's hand, a plurality of spaced spikes 30 protruding downward from the grasping member 20, and an end spike 35 protruding from a second end 22 of the grasping member 20. A self-defense chemical irritant 50 is disposed within a hollow interior chamber 25 of the grasping member 20 and an actuator mechanism 60 is provided at a first end 21 of the grasping member 20 for effectuating release thereof. The grasping member 20 alternatively functions as key-chain wherein a key-ring 40 is provided at the second end 22 thereof.

As best illustrated in FIGS. 1 through 4, it can be shown that the grasping member 20 has a first end 21, a second end 22, a top surface 23, and a bottom surface 24. The grasping member 20 also has a hollow interior chamber 25. The grasping member 20 has a generally elliptical cross section so as to be easily grasped in a user's hand.

The plurality of spaced spikes 30 are generally parallel and perpendicularly protrude from the bottom surface 24 of the grasping member 20. The plurality of spaced spikes 30 comprises a first spike 31 adjacent the first end 21 of the grasping member 20, a third spike 33 adjacent the second end 22 of the grasping member 20, and a second spike 32 intermediate the first spike 31 and the second spike 32. The first spike 31 perpendicularly protrudes from the bottom surface 24 of the grasping member 20 so as to be positionable in use between the index finger and the middle finger of a user's hand. The second spike 32 perpendicularly protrudes from the bottom surface 24 of the grasping member 20 so as to be positionable in use between the middle finger and the ring finger of a user's hand. The third spike 33 perpendicularly protrudes from the bottom surface 24 of the grasping member 20 so as to be positionable in use between the ring finger and the little finger of a user's hand. The end spike 35 perpendicularly protrudes from the second end 22 of the grasping member 20 so as to protrude in use from the palm of a user's hand.

The grasping member 20, the plurality of spaced spikes 30, and the end spike 35 are integrally formed and are formed of an aluminum alloy so as to be durable and light weight. In addition, a protective coating 19, formed of a polymeric material, is disposed on the aluminum alloy so as to prevent snagging or damaging of pocket linings or clothing and alleviate damage to the ignition and adjacent dash area of a car should the key-ring 40 be used to hold an ignition key. The key-ring 40 is retained within a hole 28 provided at the second end 22 of the grasping member 20 adjacent the top surface 23 thereof.

Figure 2:
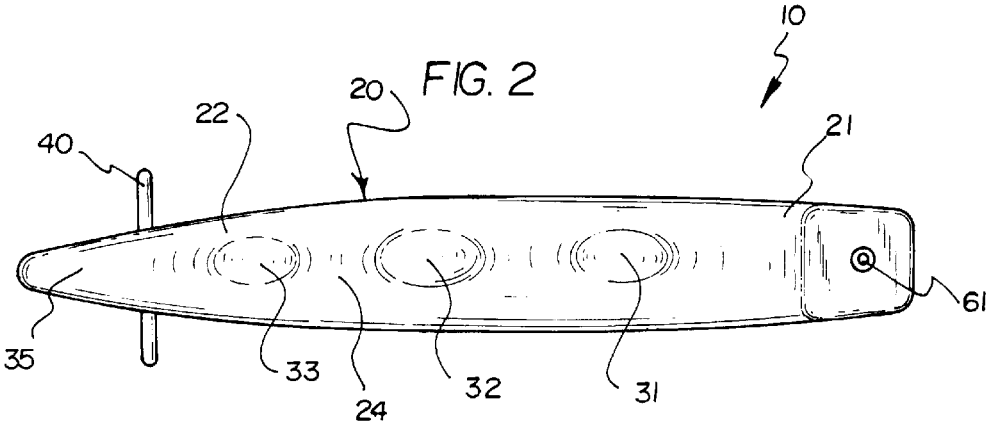
FIG. 2 is a bottom view of the present invention.
Figure 3:
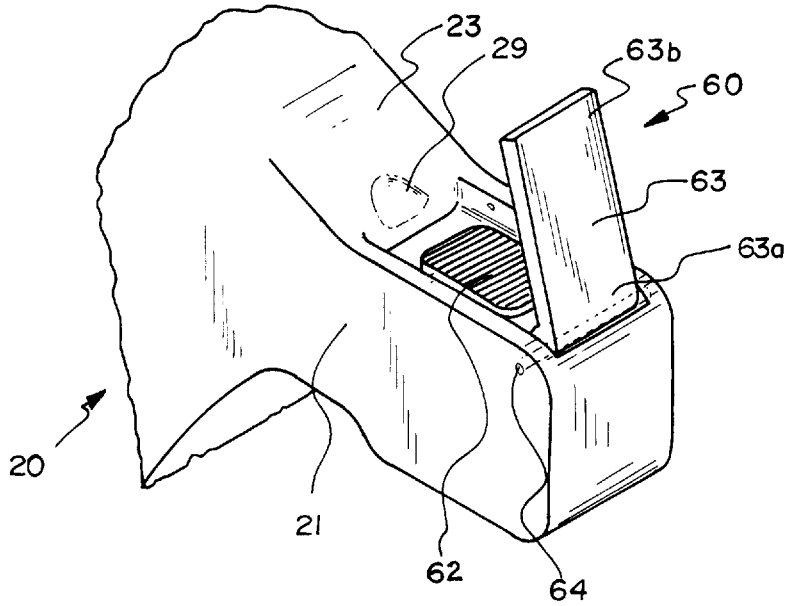
FIG. 3 is an illustration of the actuator mechanism for the self-defense chemical irritant of the present invention.
Figure 4:
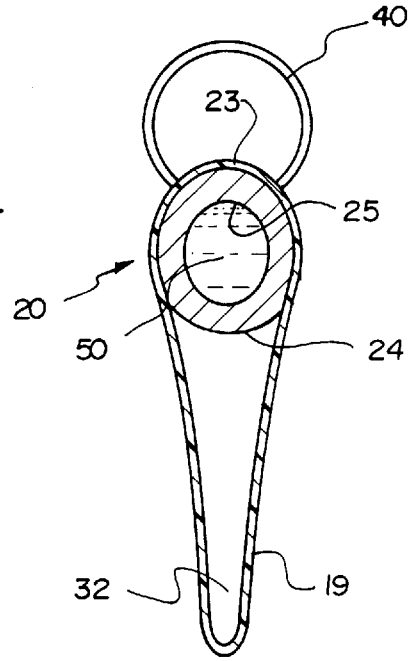
FIG. 4 is a cross sectional view taken along line 4—4 of FIG. 1.

The self-defense chemical irritant 50, disposed within the hollow interior chamber 25 of the grasping member 20, may include mace, tear gas, pepper spray, or the like. As best illustrated in FIGS. 1 through 3, it can be shown that the actuator mechanism 60 is provided at the first end 21 of the grasping member 20 for effectuating release of the self-defense chemical irritant 50. The actuator mechanism 60 includes a spray nozzle 61 and a trigger button 62 for triggering release of the self-defense chemical irritant 50. The spray nozzle 61 is provided at the first end 21 of the grasping member 20 and is disposed on the bottom surface 24 of the grasping member 20. The trigger button 62 is provided at the first end 21 of the grasping member 20 and is disposed on the top surface 23 of the grasping member 20.

A trigger cover 63 is pivotally mounted on the top surface 23 of the grasping member 20 over the trigger button 62 for preventing accidental actuation of the trigger button 62. The trigger cover 63 has a pivoting end 63*a* and a non-pivoting end 63*b* wherein the pivoting end 63*a* is pivotally coupled to the grasping member 20 by a pivot pin 64. A dimple 29 may be provided in the top surface 23 of the grasping member 20 adjacent the non-pivoting end 63*b* of the trigger cover 63 so as to permit the tip of a user's thumb to be inserted under the non-pivoting end 63*b* of the trigger cover 63. As such, the user can effectively pivot and flip the trigger cover 63 up to gain access to the trigger button 62.

Figure 5:
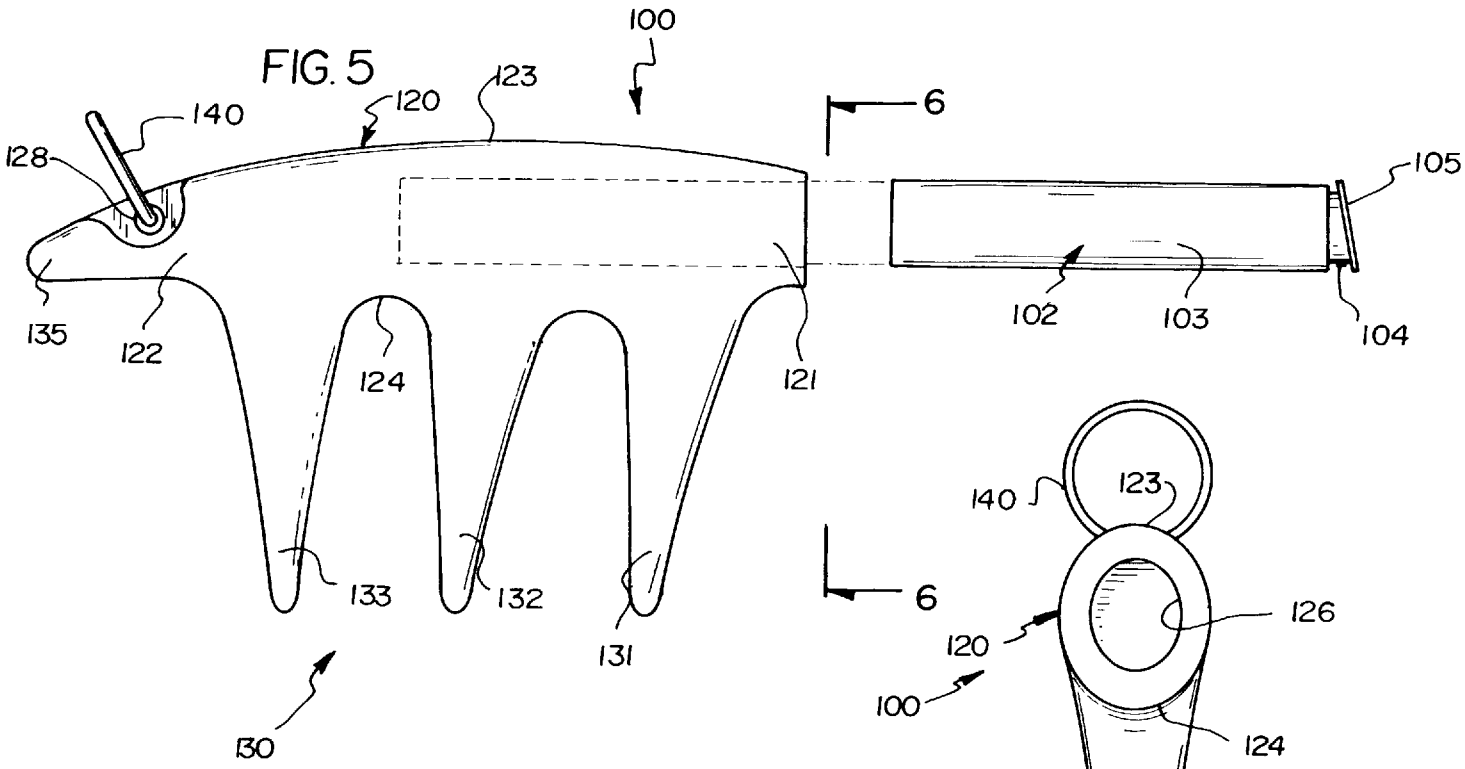
FIG. 5 is a side view of a second embodiment of the present invention receiving a replaceable self-defense chemical dispenser.
Figure 6:
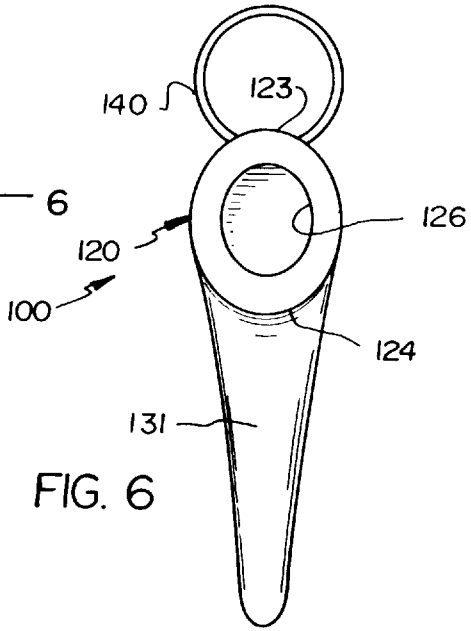
FIG. 6 is a cross sectional view taken along line 6—6 of FIG. 5.
Figure 7:
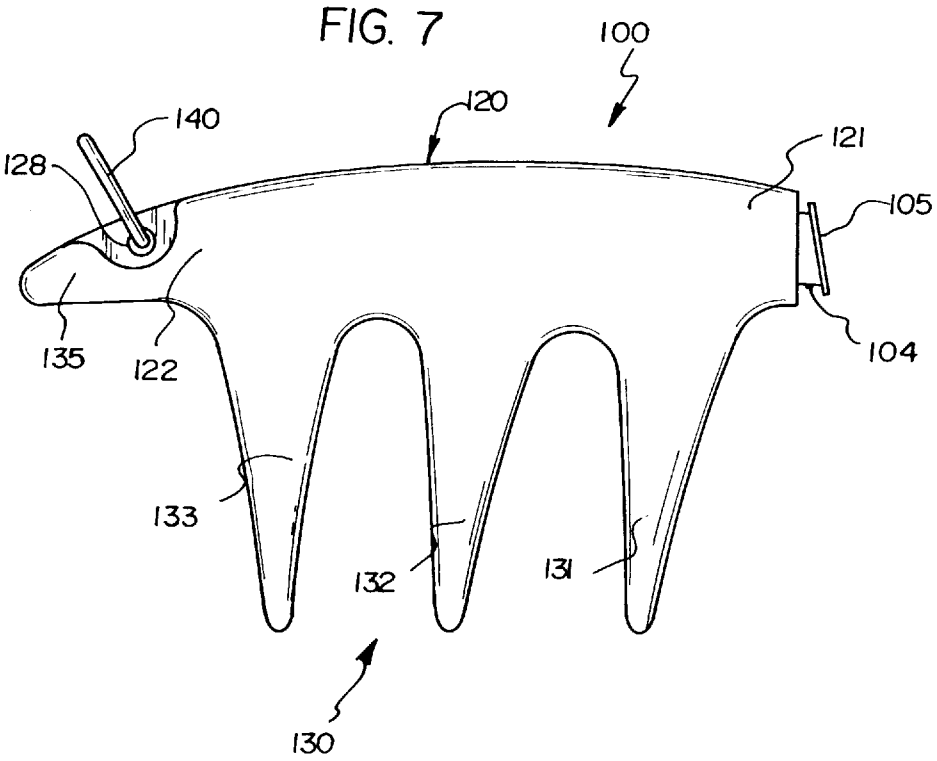
FIG. 7 is a side view of a second embodiment of the present invention with a replaceable self-defense chemical dispenser in place.

In a second embodiment, as best illustrated in FIGS. 5 through 7, it can be shown that the Self-Defense Device 100 is designed for use with a replaceable self-defense chemical dispenser 102 having a cylindrical body 103 equipped with a spray nozzle 104 and a trigger button 105. As such, the Self-Defense Device 100 comprises a grasping member 120 having a first end 121, a second end 122, a top surface 123, and a bottom surface 124, a plurality of spaced spikes 130 protruding downward from the grasping member 120, and an end spike 135 protruding from the second end 122 of the grasping member 120. The grasping member 120 has a bore 126 therein open to the first end 121 thereof. The bore 126 is adapted for receiving and retaining the cylindrical body 103 of the replaceable self-defense chemical dispenser 102 whereby the spray nozzle 104 and the trigger button 105 of the replaceable self-defense chemical dispenser 102 protrude from the first end 121 of the grasping member 120. Additionally, a key-ring 140 is retained within a hole 128 provided at the second end 122 of the grasping member 120 adjacent the top surface 123 thereof.

In use, a user of the Self-Defense Device 10 grasps the grasping member 20 such that the first spike 31 is positioned between the index finger and the middle finger of the user's hand, such that the second spike 32 is positioned between the middle finger and the ring finger of the user's hand, and such that the third spike 33 is positioned between the ring finger and the little finger of the user's hand. In addition, the trigger cover 63 is pivoted up with the user's thumb so as to allow access to the trigger button 62. As such, the user of the Self-Defense Device 10 may thwart off a would-be attacker by striking the would-be attacker with the plurality of spaced spikes 30 and the end spike 35 and may thwart off a would-be attacker by releasing the self-defense chemical irritant 50 by depressing the trigger button 62 thereby allowing the user to flee to safety.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A self-defense device comprising:

a grasping member having a first end, a second end, a top surface, and a bottom surface, said grasping member adapted for grasping thereof in a user's hand, said grasping member having a hollow interior chamber;

a plurality of spaced spikes protruding downward from said grasping member;

an end spike protruding from said second end of said grasping member;

said grasping member, said plurality of spaced spikes, and said end spike together forming a smooth continuous surface without any sharp surfaces;

a self-defense chemical irritant disposed within said hollow interior chamber of said grasping member; and an actuator means for effectuating release of said self-defense chemical irritant.

2. The self-defense device of claim 1, wherein said grasping member has a generally elliptical cross section so as to be easily grasped in the user's hand.

3. The self-defense device of claim 1, wherein said plurality of spaced spikes are generally parallel and perpendicularly protrude from said bottom surface of said grasping member, wherein said plurality of spaced spikes comprises a first spike adjacent said first end of said grasping member, said first spike positionable in use between the index finger and the middle finger of the user's hand, a third spike adjacent said second end of said grasping member, said third spike positionable in use between the little finger and the ring finger of the user's hand, and a second spike intermediate said first spike and said third spike, said second spike positionable in use between the ring finger and the middle finger of the user's hand, and wherein said end spike perpendicularly protrudes from said second end of said grasping member so as to protrude in use from the palm of the user's hand.

4. The self-defense device of claim 1, wherein said actuator means includes a spray nozzle and a trigger button for triggering release of said self-defense chemical irritant, said spray nozzle provided at said first end of said grasping member and disposed on said bottom surface of said grasping member, said trigger button provided at said first end of said grasping member and disposed on said top surface of said grasping member.

5. The self-defense device of claim 4, further comprising:

a trigger cover pivotally mounted on said top surface of said grasping member over said trigger button for preventing accidental actuation of said trigger button.

6. The self-defense device of claim 1, further comprising:

a key-ring provided at said second end of said grasping member.

7. A self-defense device for use with a replaceable self-defense chemical dispenser having a cylindrical body equipped with a spray nozzle and a trigger button, said self-defense device comprising:

a grasping member having a first end, a second end, a top surface, and a bottom surface, said grasping member adapted for grasping thereof in a user's hand, said grasping member having a bore therein, said bore open to said first end of said grasping member, said bore adapted for receiving and retaining said cylindrical body of said replaceable self-defense chemical dispenser whereby said spray nozzle and said trigger button of said replaceable self-defense chemical dispenser protrude from said first end of said grasping member;

a plurality of spaced spikes protruding downward from said grasping member;

an end spike protruding from said second end of said grasping member; and said grasping member, said plurality of spaced spikes, and said end spike together forming a smooth continuous surface without any sharp surfaces.

8. The self-defense device of claim 7, wherein said grasping member has a generally elliptical cross section so as to be easily grasped in the user's hand.

9. The self-defense device of claim 7, wherein said plurality of spaced spikes are generally parallel and perpendicularly protrude from said bottom surface of said grasping member, wherein said plurality of spaced spikes comprises a first spike adjacent said first end of said grasping member, said first spike positionable in use between the index finger and the middle finger of the user's hand, a third spike adjacent said second end of said grasping member, said third spike positionable in use between the little finger and the ring finger of the user's hand, and a second spike intermediate said first spike and said third spike, said second spike positionable in use between the ring finger and the middle finger of the user's hand, and wherein said end spike perpendicularly protrudes from said second end of said grasping member so as to protrude in use from the palm of the user's hand.

10. The self-defense device of claim 7, further comprising:

a key-ring provided at said second end of said grasping member.

* * * * *